US008732867B2

(12) United States Patent
Cho

(10) Patent No.: US 8,732,867 B2
(45) Date of Patent: May 27, 2014

(54) BAG FOR PANT POCKET WITH A PLURALITY OF INTERNAL POCKETS AND METHOD OF FABRICATING THE SAME

(71) Applicant: Kang Rai Cho, Seoul (KR)

(72) Inventor: Kang Rai Cho, Seoul (KR)

( * ) Notice: Subject to any disclaimer, the term of this patent is extended or adjusted under 35 U.S.C. 154(b) by 0 days.

(21) Appl. No.: 13/870,606

(22) Filed: Apr. 25, 2013

(65) Prior Publication Data

US 2013/0239297 A1 Sep. 19, 2013

Related U.S. Application Data

(63) Continuation of application No. PCT/KR2011/007975, filed on Oct. 25, 2011.

(30) Foreign Application Priority Data

Oct. 25, 2010 (KR) ..... 10-2010-0103964

(51) Int. Cl.
*A41D 27/20* (2006.01)

(52) U.S. Cl.
USPC ..... 2/247; 2/250

(58) Field of Classification Search
CPC ..... A41D 27/20
USPC ..... 2/247, 250, 253, 227, 228, 69
See application file for complete search history.

(56) References Cited

U.S. PATENT DOCUMENTS 2,087,123 A * 7/1937 Serak ..... 2/253
2,224,735 A * 12/1940 Leary ..... 198/430
2,251,576 A * 8/1941 Puodis ..... 2/253
2,407,888 A * 9/1946 Lesser ..... 2/253
2,596,525 A * 5/1952 Buelow ..... 2/227
2,859,449 A * 11/1958 Ellison ..... 2/253
2,882,532 A * 4/1959 O'Donnell ..... 2/253
2,967,307 A * 1/1961 O'Donnell ..... 2/253
4,499,612 A * 2/1985 Koike ..... 2/250

FOREIGN PATENT DOCUMENTS

JP 11-117110 A 4/1999
KR 20-1998-0059665 U 10/1998
KR 20-0248633 Y1 11/2001
KR 20-0268850 Y1 3/2002
KR 10-0614149 B1 8/2006
KR 10-0876151 12/2008

* cited by examiner

*Primary Examiner* — Gloria Hale
(74) *Attorney, Agent, or Firm* — Edwards Wildman Palmer LLP; Kongsik Kim; Carolina E. Save

(57) ABSTRACT

A bag for a pant pocket according to the present invention further includes an intermediate pocket that is disposed between the first sheet and the second sheet, with the edge attached throughout the entire section to the second sheet and has at least two or more internal inlets formed in the shape of a through-hole though both sides so that going in and out of an internal space formed by the attachment is possible, in which an internal pocket separate line for attaching the second sheet and the intermediate sheet in the structure of separating the areas including two or more internal inlets, respectively is provided, the edge except the partial section of the first sheet is attached to the intermediate sheet to form the main inlet, and the receiving spaces are more easily used by providing at least two or more separate specific internal pocket spaces in one pocket.

6 Claims, 10 Drawing Sheets

BAG FOR PANT POCKET WITH A PLURALITY OF INTERNAL POCKETS AND METHOD OF FABRICATING THE SAME

CROSS-REFERENCE TO RELATED APPLICATIONS

This is a continuation of International Application No. PCT/KR2011/007975 filed on Oct. 25, 2011, which claims priority to Korean Application No. 10-2010-103964 filed on Oct. 25, 2010, which applications are incorporated herein by reference.

TECHNICAL FIELD

The present invention relates to a bag for a pant pocket which is one of the pockets of pants such as trousers and skirts, and more particularly, to a pant pocket which is attached to the inside of a pocket opening of pants, for example, by sawing so that various things that were put inside through the pocket opening can be held.

BACKGROUND ART

Most clothing that people wear generally has pockets for protecting the parts of a body such as hands from the cold by putting them in the pockets in the cold weather or for holding things therein.

Those pockets are composed of an opening generally formed on the outer side of clothing and a bag with a predetermined space in the shape of a sack inside the clothing. In general, the opening is formed by cutting the outer cover of clothing at a predetermined distance and the bag is formed in the shape of a sack with an inlet attached to the inside edge of the opening.

A typical pant pocket that has been used is shown in FIGS. 7 and 8. As shown in FIG. 7, the bag inside clothing such as pants is formed generally by sewing two pieces of fabric, that is, a first sheet 10 and a second sheet 20 along the edges with a seam 50 to make a closed space in the shape of a sack, in which in order to make an open main inlets 30, the seam 50 may not be formed at the corresponding portion.

The bag fabricated as described above is attached to the inner side of pants such as trousers in the type shown in FIG. 8 and the bag inside the pants is indicated by a dotted line in the figure.

That is, the main inlets 30 of the bag are attached, for example, by sewing along the inner edge an opening 100 to make it possible to reach it through the opening 100 formed on the outer side of the pants from the outside, and thus the bag is fixed to the inner side of the pants and various things can be put into the bag through the opening 100 from the outside.

However, when a pant pocket is formed in the structure of the related art shown in FIGS. 7 and 8, there is a serious defect in terms of the function of carrying things in that there is a high possibility of loss of the thing kept in the pocket.

The possibility of the problem is not high, when the person wearing the pants stands or walks, but, for example, the person sits or lies down and the person's thighs are placed almost parallel with the floor, the side edge of the bag extending from one end of the inlet 30 is also almost parallel with the floor; therefore, the things in the bag easily come out through the pocket opening 100 along the side edge of the bag, and accordingly, it is frequent that the important things in the bag in the pocket come out and are lost without the person's recognizing it.

Another problem of the pocket with the structure of the related art is that when there are several things to carry in the pocket, the space for receiving the things is narrow and it is difficult to discriminate the things, so a user carries the things in the pant pocket at the hip in some cases. However, there has been issued a research saying that things such as a purse are more likely to come out through the opening of the pocket at the hip, so called a hip pocket, and when the person is seated for a long time with a thick thing such as a purse in any one hip pocket of the left and right pocket, serious disorders of the body such as twisting of the spine or warping of the pelvis are likely to be caused.

A method of attaching a cover over the opening 100 of the pocket has been proposed to reduce the possibility of a loss in the problems described above, but there is a problem in this method in that the fabrication labor for attaching the cover and the material costs are increased and it is required to necessarily add a specific structure, which interferes various modifications and configurations in design in clothing of which the design is important as a fashion product.

On the other hand, a piece of pants with pockets having a specific sub-pocket 300 inside, as shown in FIG. 9, has been proposed to increase the efficiency of separate management of carried things. However, there is a structural limit of attaching it to a partial area in the space of the pocket, and accordingly, it is difficult to ensure a predetermined size or more of internal space for the sub-pocket 300 and there is a limit in the kinds of things to carry. Further, the fabrication labor for attaching the specific sub-pocket 300 is necessary and there is no improvement in terms of the possibility of loss that is a problem in the pocket of the related art described above.

Accordingly, the applicant(s) of the present invention has proposed a 'pant bag' in Korean patent Registration No. 614149, which can effectively prevent loss of carried things by changing only the structure of a bag in a pocket so that the rear edge of the bag is elongated back behind the side line of a piece of pants such as trousers, and by making the pocket inlet in a double structure, in order to provide a pocket that reduces the possibility of loss of carried things and has a wide separate space.

In this invention, only the shape of the bag inside is changed with the external appearance of pants of the related art kept, and thus there is a remarkable effect that it is possible to effectively prevent loss of carried objects, in addition to using the pocket for various types of pants without a limit.

However, there is a defect that the fabrication labor increases a little in comparison to the process of fabricating basic pockets of the related art. Therefore, the applicant(s) has proposed a 'bag for a pant pocket' as well which can effectively prevent things in the pocket from coming out without increasing the fabrication labor in Korean Patent Registration No. 876151, in comparison to the pant pockets of the related art and an example of the bag for a pant pocket is shown in FIG. 10.

The patent of the bag for a pant pocket described above provides technical information which makes it possible to fabricate a bag for a pant pocket which further includes an intermediate sheet 15 with an inner inlet 151 disposed between the first sheet 10 and the second sheet 20 and has a separate internal space without a possibility of loss by forming the second sheet 20 and the intermediate sheet 15 in the same shape, forming the first sheet 10 with one edge cut from the same shape of the second sheet 20 etc., and then only by serially overlapping them so that the outlines coincide with each other and forming a seam 50 along the outlines. Therefore, as compared with the bags for pant pocket of the related art, it is possible to fabricate a bag for a pant pocket that is fabricated without an increase in fabrication labor and difficulty of work, has a separate wide space effectively preventing loss of things without an influence on the external design of clothing, and can be widely used for various types of pant pockets of the related art.

That is, the bag for a pant pocket having the configuration described above has the advantage that it possible to provide a volume double the volume of pockets of the related art and to considerably reduce possibility of loss of thing due to the structural features of the inner inlet 151, when the things are stored in the internal space formed between the intermediate sheet 15 and the second sheet 20.

However, the advantage that the size of the space is considerably large, unlike the sub-pockets of the related art when the internal space is formed as one communicating space causes efficient carrying to be difficult in some cases.

That is, when small things are stored, they are not specifically positioned in the wide space, and accordingly, it may be a little troublesome to hold and put the things out, and when many things are stored, they collect and make the bag bulgy, which may interfere with efficient use of the space.

SUMMARY OF THE DISCLOSURE

In order to overcome the problems of the related art described above, an object of the present invention is to provide a bag for a pant pocket with a internal pocket that can effectively prevent things in the pocket from coming out without increasing fabrication labor in comparison to the pockets of the related art, can maximize the receiving volume of an internal space formed in the pocket and possibility of using the space, has a shape making it easier to receive/take out the things in the pocket, can allow things to be separately received in the internal space of the pocket, and can prevent deterioration of external appearance and activity due to bulging outward of the bag by overlapping of the things in the pocket.

In order to achieve the objects of the present invention, a bag for a pant pocket with a plurality of internal pockets according to the present invention includes a first sheet and a second sheet of which the edges are attached throughout the entire section without a partial section, in which the partial section not attached makes a main inlet and the edge of the main inlet is attached to the inner side of an opening of the pant pocket such as trousers and skirts to make a pant pocket in the shape of allowing a wearer to put a hand inside or of receiving various things in itself. The bag for a pant pocket further includes an intermediate sheet that is disposed between the first sheet and the second sheet, with the edge attached throughout the entire section to the second sheet and has at least two or more internal inlets formed in the shape of a through-hole though both sides so that going in and out of an internal space formed by the attachment is possible. An internal pocket separate line for attaching the second sheet and the intermediate sheet in the structure of separating the areas including two or more internal inlets, respectively is provided and the edge except the partial section of the first sheet is attached to the intermediate sheet to form the main inlet.

The internal inlets of the intermediate sheet may be formed in a long slot shape extending from one point on the surface of the intermediate sheet to edge portion.

The intermediate sheet and the second sheet may be made of the same shape of sheets, the first sheet may have a shape with a portion of the edge cut in the same shape of sheet as the intermediate sheet and the second sheet, and the attachment line for attaching the second sheet and the intermediate sheet, and the edges of the intermediate sheet and the first sheet may be a seam for attaching the outer edges of the intermediate sheet and the second sheet, with the first sheet, the intermediate sheet, and the second sheet overlapped in the same shape.

A method of fabricating a bag for a pocket with a plurality of internal pockets according to the present invention may include: preparing the same shape of second sheet and intermediate sheet, and the first sheet shaped by cutting a portion of the edge in the same shape as the second sheet and the intermediate sheet; forming at least two or more internal inlets in the shape of a through-hole through both sides at the intermediate sheet; overlapping the intermediate sheet with two or more internal inlets and the second sheet such that the outer edges coincide with each other, and then forming an internal pocket separation line attaching the second sheet and the intermediate sheet in the structure of separating areas each including one of the internal inlets; and sewing the entire section of the overlapped outlines of the intermediate sheet and the second sheet after overlapping the first sheet, the intermediate sheet, and the second sheet, with the outer edges coinciding with each other, after the separating of internal pockets.

The internal inlets of the intermediate sheet are formed in a long slot shape extending from one point on the surface of the intermediate sheet.

According to the configuration described above, the bag for a pocket with a plurality of internal pockets according to the present invention has the following effects.

First, it is possible to provide a bag for a pocket with a plurality of internal pockets that can maximize the receiving volume and effectively prevent thing in the pocket from coming out without an increase in fabrication labor and difficulty of work in comparison to the bags for pant pocket of the related art, and can more easily use the receiving spaces by providing at least two or more separate specific internal pocket spaces in one pocket.

Second, it is possible to provide a bag for a pocket with a plurality of internal pockets which can prevent deterioration of the stylishness and activity of clothing when carrying things and making it easier to hold or take out the received things, because at least two or more internal pockets are provided and things received in the pockets does not overlap.

DETAILED DESCRIPTION

Figure 1:
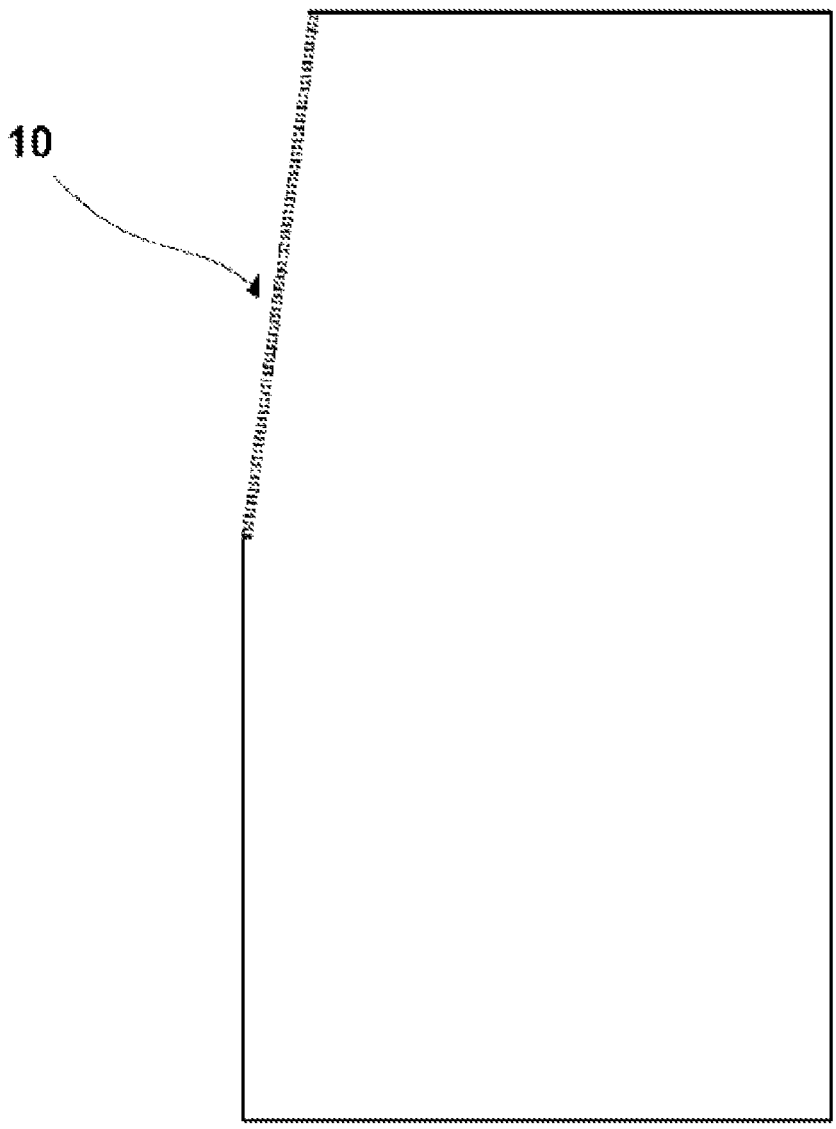
FIG. 1 is a view showing a first sheet of a bag for a pant pocket with a plurality of internal pockets according to a preferable embodiment of the present invention.

A bag for a pant pocket with a plurality of internal pockets according to the present invention includes a first sheet and a second sheet of which the edges are attached throughout the entire section without a partial section, in which the partial section not attached makes a main inlet and the edge of the main inlet is attached to the inner side of an opening of the pant pocket such as trousers and skirts to make a pant pocket in the shape of allowing a wearer to put a hand inside or of receiving various things in itself. The bag for a pant pocket further includes an intermediate sheet that is disposed between the first sheet and the second sheet, with the edge attached throughout the entire section to the second sheet and has at least two or more internal inlets formed in the shape of a through-hole though both sides so that going in and out of an internal space formed by the attachment is possible. An internal pocket separate line for attaching the second sheet and the intermediate sheet in the structure of separating the areas including two or more internal inlets, respectively is provided and the edge except the partial section of the first sheet is attached to the intermediate sheet to form the main inlet.

Hereinafter, the configuration of the present invention will be described in more detail with reference to the accompanying drawings showing preferable embodiments of the present invention.

The components having the same or similar function as in the related art described above are given the same reference numerals for the convenience of understanding in the following description.

Figure 2:
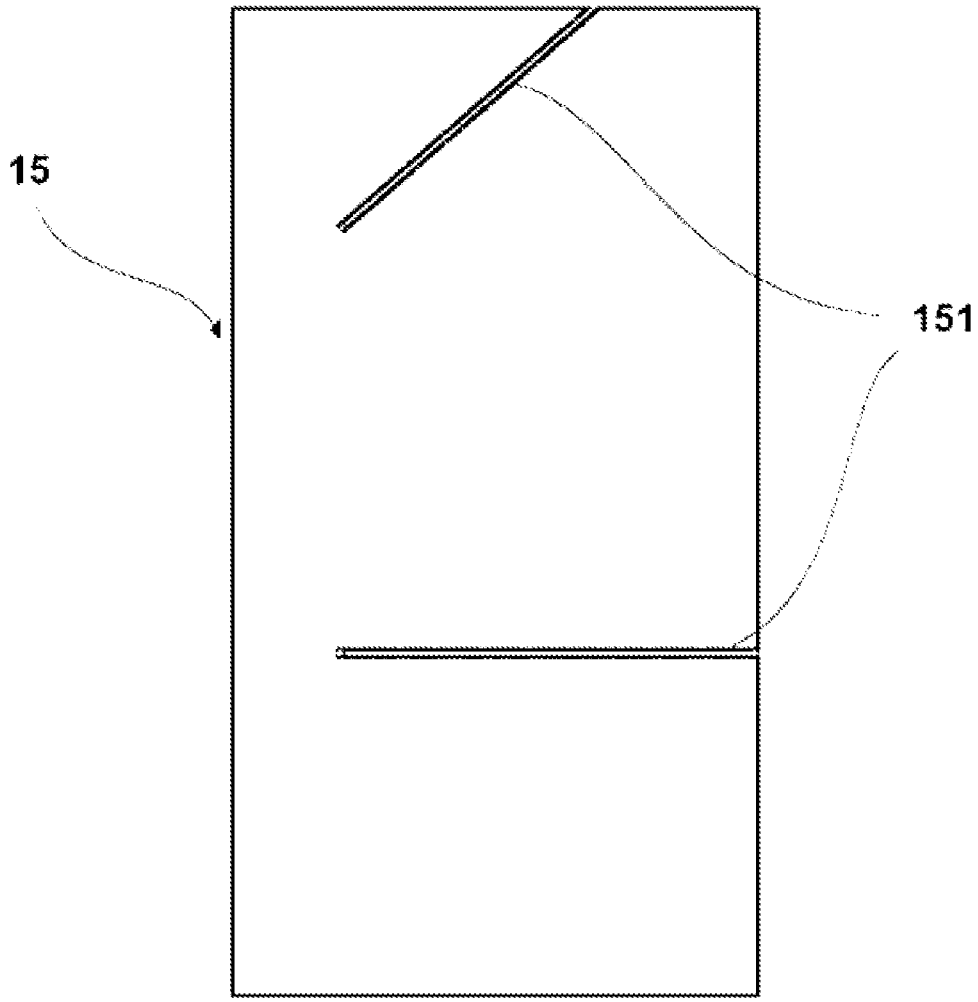
FIG. 2 is a view showing an intermediate sheet of a bag for a pant pocket with a plurality of internal pockets according to a preferable embodiment of the present invention.
Figure 3:
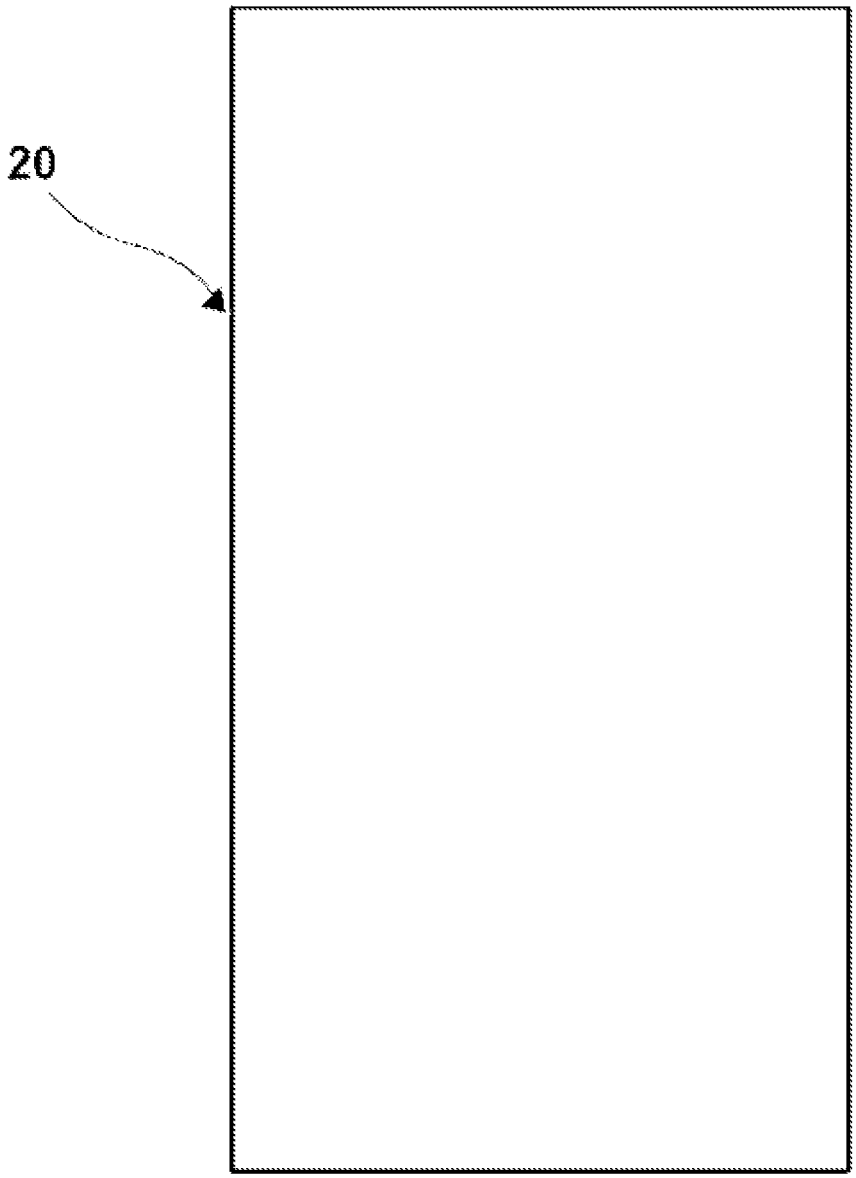
FIG. 3 is a view showing a second sheet of a bag for a pant pocket with a plurality of internal pockets according to a preferable embodiment of the present invention.

FIGS. 1 to 3 are views respectively showing a first sheet 10, an intermediate sheet 15, and a second sheet 20 of a bag for a pant pocket with a plurality of internal pockets according to a preferable embodiment of the present invention.

The bag for pant pocket with a plurality of internal pockets according to the present invention also includes the first sheet 10 and the second sheet 20, which are the outer sheet of the bag, and the intermediate sheet 15 disposed between the first sheet 10 and the second sheet 20, with the entire edge attached to the second sheet 20.

The first sheet 10 according to the embodiment, as shown in FIG. 1, is generally formed in a rectangular shape fitting to the basic shape easily used for pant pockets of the related art and one end of the upper points of the bag is diagonally cut, and thus it has a shape with a portion of the edge cut in the rectangular shape of the second sheet 20 and the intermediate sheet 15, which are described below. With the features of the shape, when all the sheets are overlapped and sewn along the edge, the cut portion not attached by the seam may be formed to configure a main inlet 30.

When the entire section of the edges of the intermediate sheet 15 in FIG. 2 and the second sheet 20 in FIG. 3 are attached, a closed internal space is formed between the intermediate sheet 15 and the second sheet 20, in which two or more internal inlets 151 formed in the shape of a through-hole through both sides, as shown in FIG. 2, are provided on the surface of the intermediate sheet 15 so that it is possible to go in/out of the closed internal space.

The two or more internal inlets 151 described above has a specific configuration for the objects of the present invention and a specific configuration of separating the internal space between the intermediate sheet 15 and the second sheet 20 into two or more may be induced by adding another specific configuration to describe below.

The configuration is implemented by the attachment structure of attaching the second sheet 20 and the intermediate sheet 15 at a specific position and separating the area of the internal space into two or more and the attachment relationship is described with reference to FIG. 4.

Figure 4:
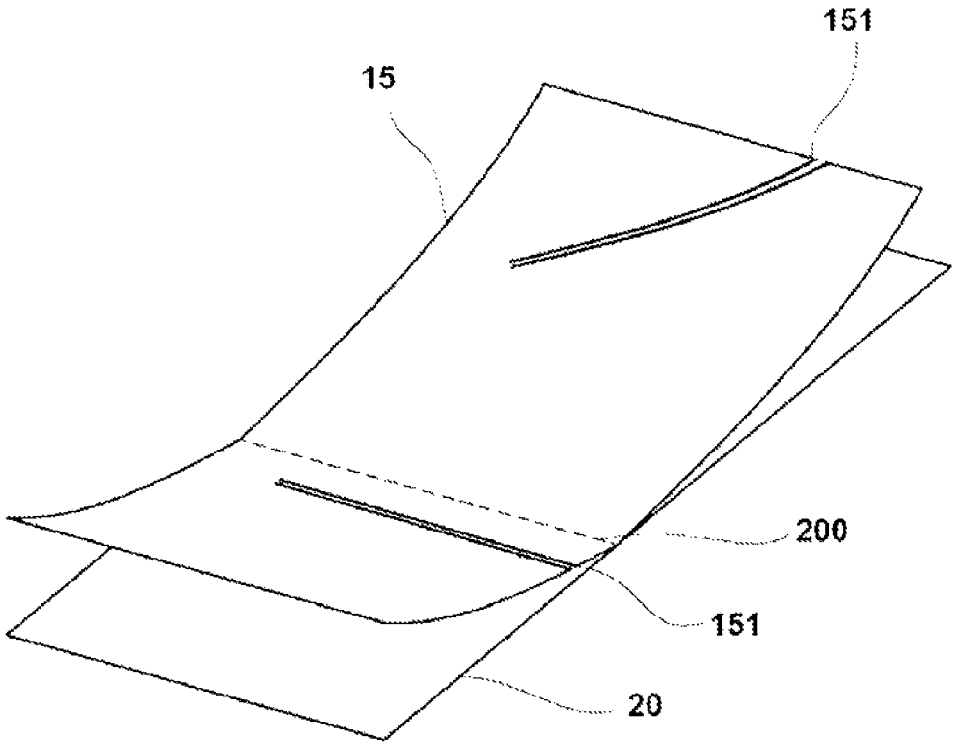
FIG. 4 is an exploded perspective view showing the attachment relationship through an internal pocket separate line of the second sheet and the intermediate sheet of the bag for a pant pocket with a plurality of internal pockets according to a preferable embodiment of the present invention.

An internal pocket separate line 200 in FIG. 4 is formed to separate the internal space between the second sheet 20 and the intermediate sheet 15, and more precisely, it is formed on the purpose of dividing a plurality of areas in the internal pockets having at least two or more internal linnets 151 of the intermediate sheet 15, respectively, when the entire edges of the intermediate sheet 15 and the second sheet 20 are attached.

In order to achieve the configuration described above, the internal pocket separation line 200 extends from a point of the edges at the same position on the intermediate sheet 15 and the second sheet 20 to a point on the opposite edge, crossing between the internal inlets 151, and accordingly, when the entire edges of the second sheet 20 and the intermediate sheet 15 and the internal pocket separation line 200 are attached to each other, for example, by sewing, two accessible internal pockets are formed between the second sheet 20 and the intermediate sheet 15 by the internal pocket separation line 200.

However, for the entire edges of the second sheet 20 and the intermediate sheet 15 which are attached to each other, since the entire edges are almost the same as the attachment section with the first sheet 10, in order to simplify the fabrication process, it is preferable to form only the internal pocket separation line 200 first on the second sheet 20 and the intermediate sheet 15 and then form an outer seam at a time after overlapping the first sheet 10, as described below with reference to FIG. 5.

It is preferable to elongate the two internal inlets 151 from one point on the surface of the intermediate sheet to the edge in a long slot shape in order to prevent thing in the internal pockets from easily coming out and to put/take things in/out by increasing the area of the inlet.

Further, as shown in figure, the internal inlet 151 at the upper portion of the figure, positioned close to the opening 100 of the pocket is formed diagonally across the intermediate sheet 15 from one point of the edge on the upper end surface of the intermediate sheet 15 and the lower internal inlet 151 positioned deep in the pocket is formed horizontally to coincide with the angle of the user's hand coming in/out of the pocket so that the user can easily put/take thing in/out, but this configuration may be appropriately changed in accordance with the number and the position of the separated internal pockets.

Figure 5:
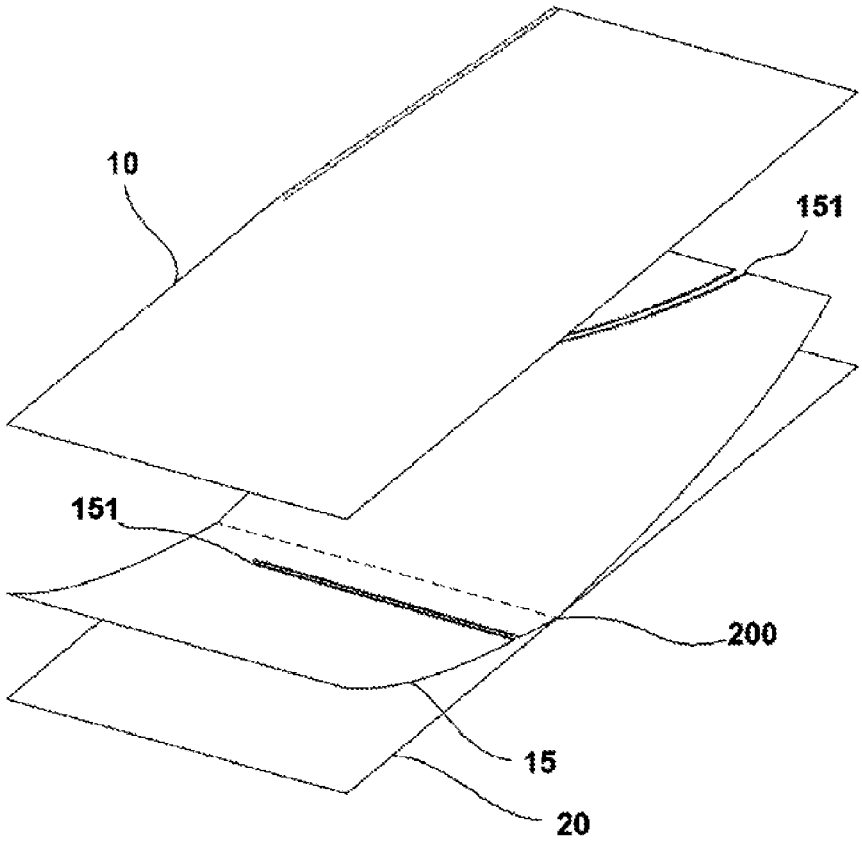
FIG. 5 is an exploded perspective view showing the attachment relationship of the sheets of the bag for a pant pocket with a plurality of internal pockets according to a preferable embodiment of the present invention.

FIG. 5 is an exploded perspective view showing when the first sheet is overlapped on the attachment structure of the intermediate sheet 15 and the second sheet 20, which is described referring to FIG. 4, to fit to the outer edge shape.

According to the configuration described above, when the sheets are overlapped with the outer edges coinciding with each other so that the intermediate sheet 15 is disposed between the first sheet 10 and the second sheet 20, over the intermediate sheet 15 and the second sheet 20 of which the middle portions for separating the area through the internal pocket separation line 200 are attached to each other, the other edges except the cut portion of the first sheet 10 coincide with each other.

In this position, when the entire sections of the outer edges of the intermediate sheet 15 and the second sheet 20 are sewn, similar to the process of fabricating a common pocket bag composed of only two sheets, a bag for pocket with two internal spaces and one common space is achieved only by one time of sewing.

Figure 6:
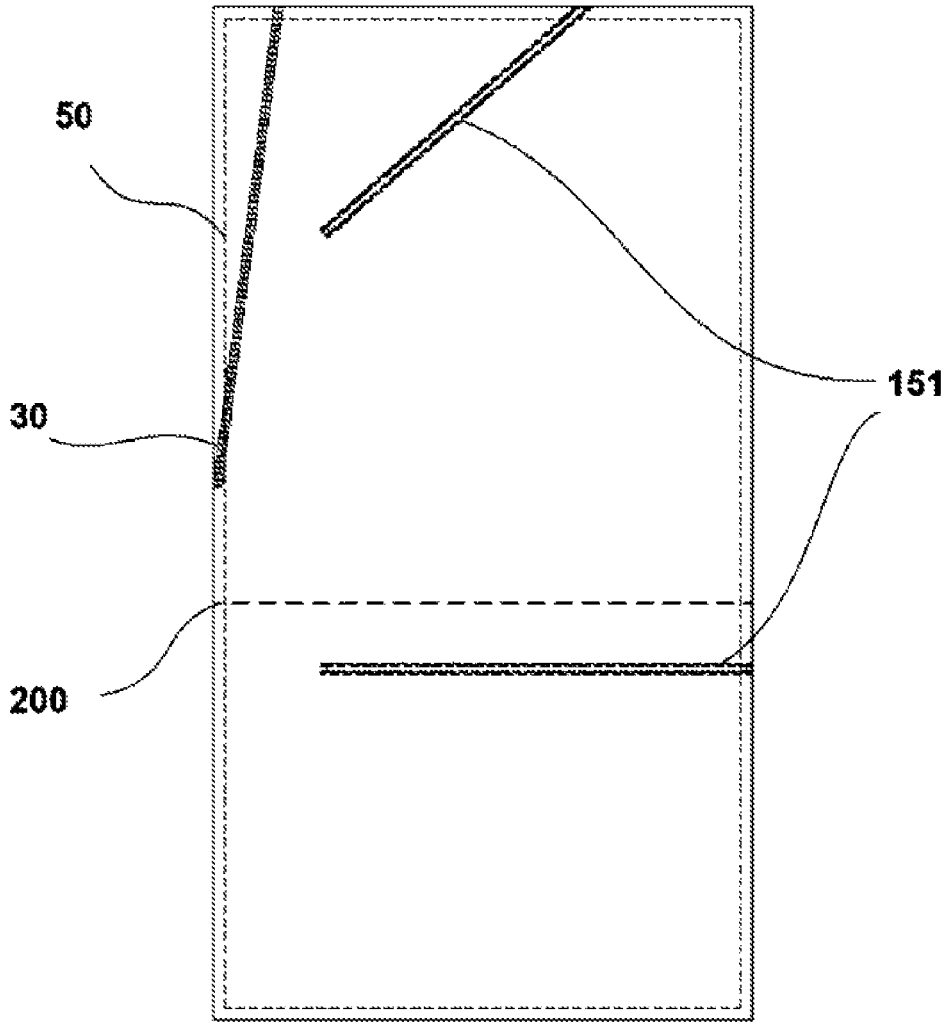
FIG. 6 is a perspective view showing the entire shape of a bag for a pant pocket with a plurality of internal pockets according to a preferable embodiment of the present invention.
Figure 7:
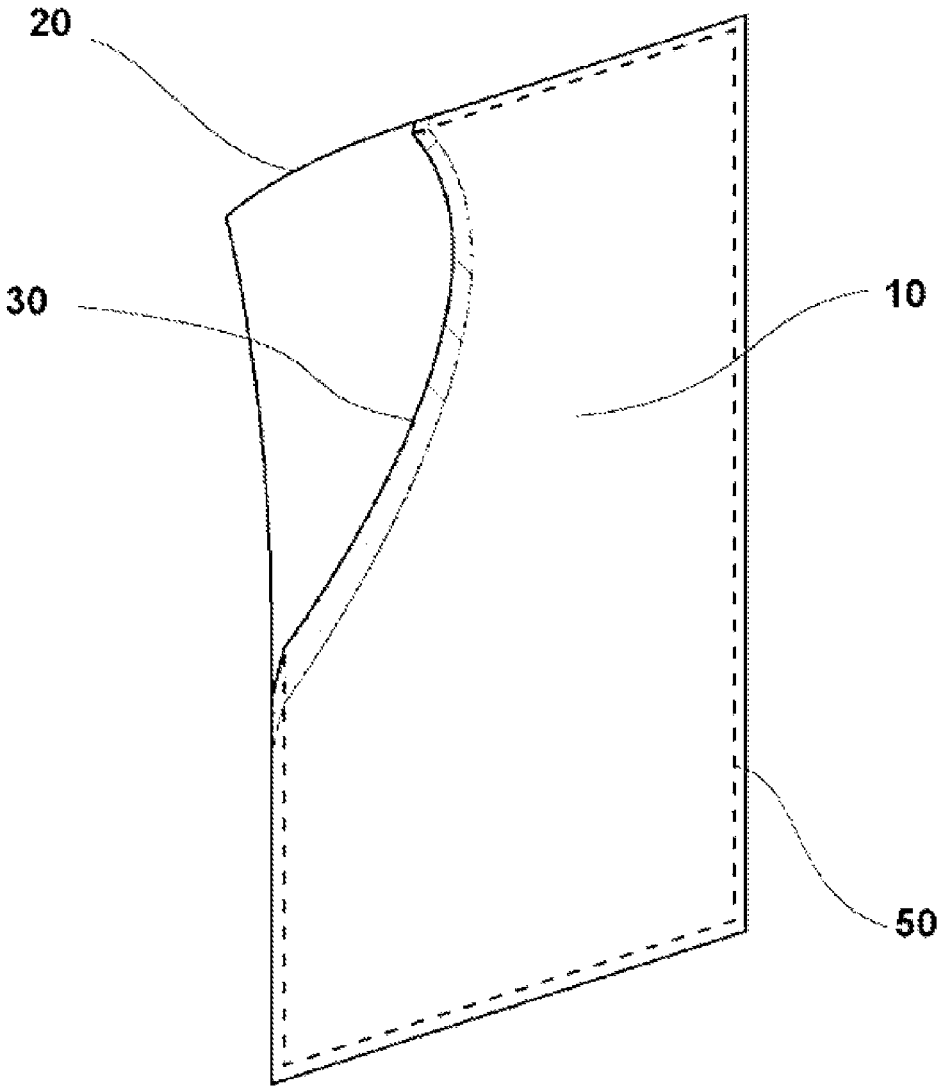
FIG. 7 is a perspective view of a bag for a pant pocket according to the related art.
Figure 8:
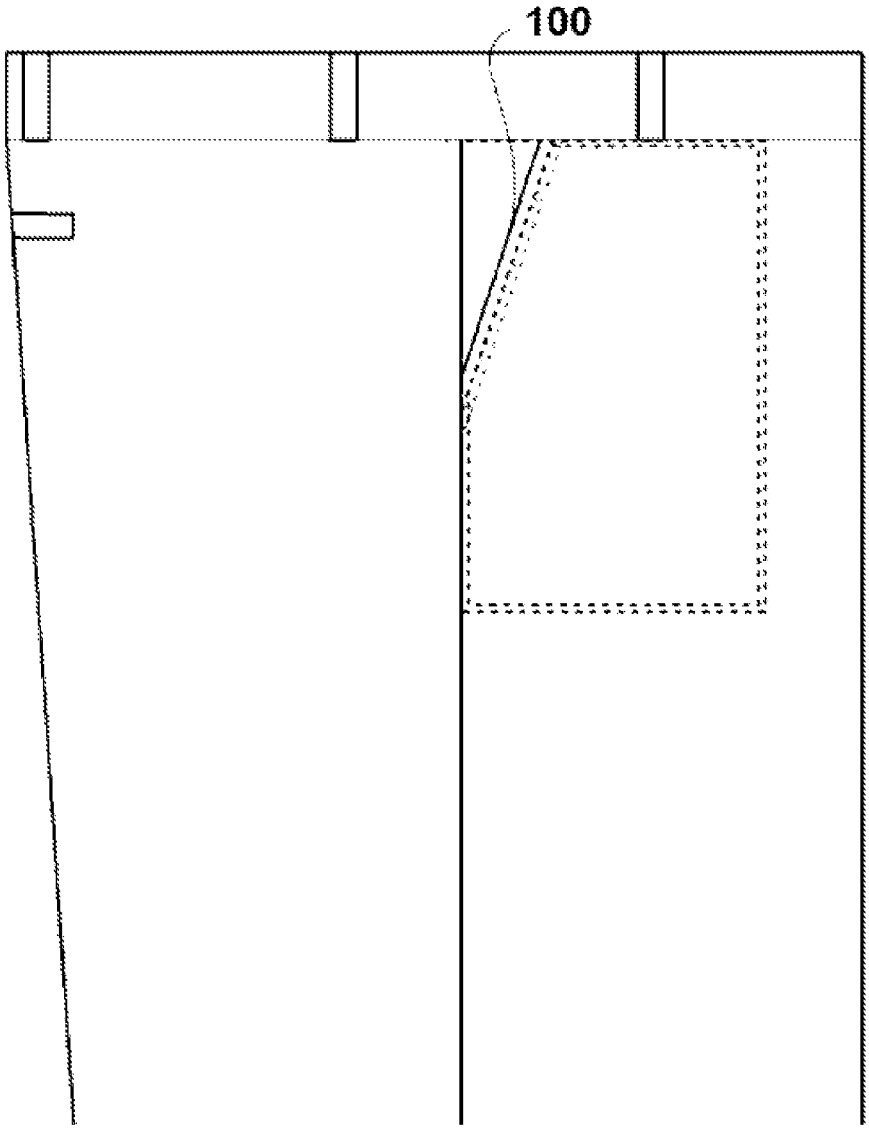
FIG. 8 is a view showing a piece of pants with the bag for a pant pocket shown in FIG. 7.
Figure 9:
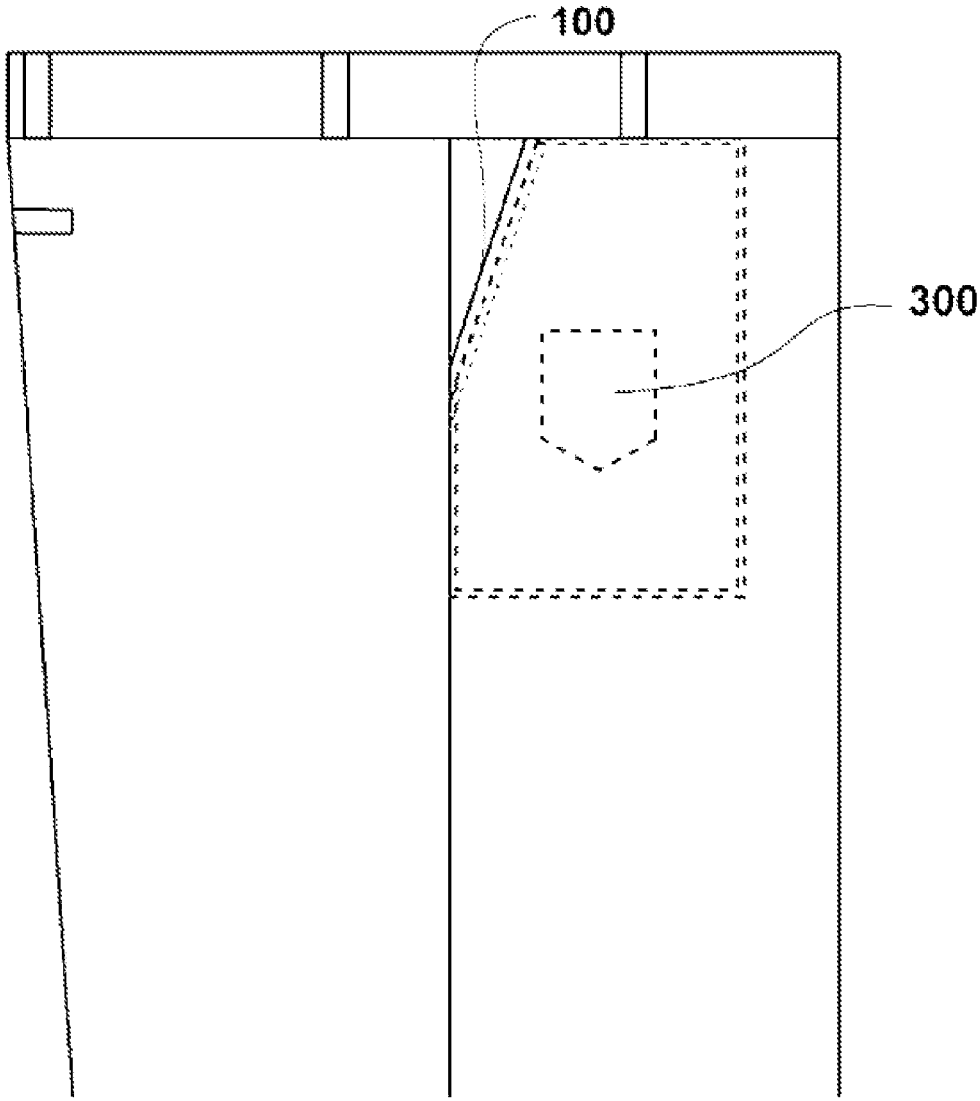
FIG. 9 is a view showing a piece of pant with a bag for a pant pocket having a sub-pocket.
Figure 10:
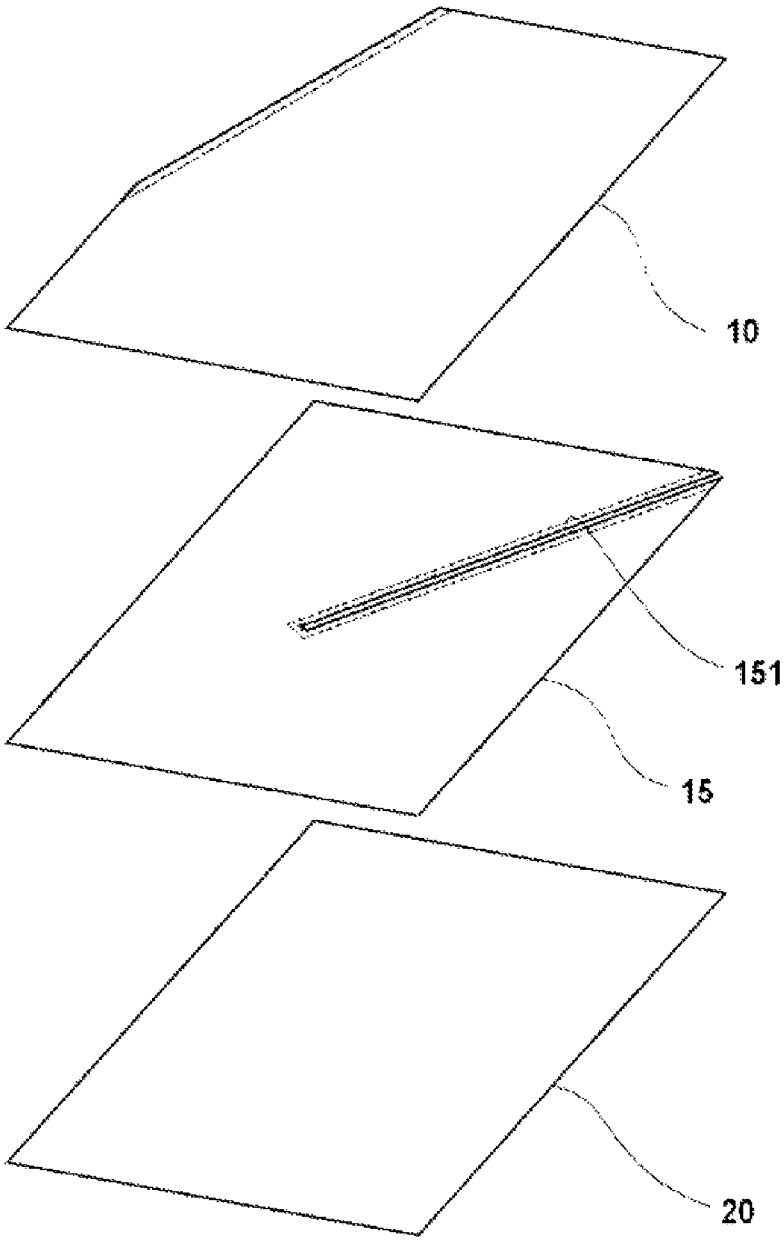
FIG. 10 is an exploded perspective view showing the arrangement relationship of sheets of a bag for a pant pocket according to another related art.

That is, as can be seen from FIG. 6 that is a perspective view of a completed pocket bag, showing the positional relationships by indicating the pocket separation line 200 in the bag and the internal inlets 151 with dotted line, two internal pockets with minimum possibility of loss each of which has the internal inlet 151 are formed between the intermediate sheet 15 and the second sheet and, outside them, and a common pocket bag space is formed between the first sheet 10 and the intermediate sheet 15. It is a remarkable advantage of the present invention that the useful spaces can be formed even without a large change in the process of fabricating common pockets of the related art.

Therefore, an optimized process for fabricating a bag for a pant pocket with a plurality of internal pockets having the structure described above is briefly described below.

First, as a step of preparing sheets, the same shape of second sheet 20 and intermediate sheet 15, and the first sheet 10 shaped by cutting a portion of the edge in the same shape as the second sheet 20 and the intermediate sheet 15 are prepared.

Next, as a step of forming internal inlets, at least two or more internal inlets 151 are formed in the shape of a through-hole through both sides at the intermediate sheet 15, which is included in the step of preparing the intermediate sheet in a wide sense.

Next, as a step of separating the internal pockets, the intermediate sheet 15 with two or more internal inlets 151 and the second sheet 20 are overlapped such that the outer edges coincide with each other, and then an internal pocket separation line 200 attaching the second sheet 20 and the intermediate sheet 15 is formed in the structure of separating areas each including one internal inlet. The internal pocket separation line 200 can be easily achieved by sewing, as described above.

Finally, as a step of sewing the edges, the first sheet 10 is placed over the intermediate sheet 15 and the second sheet 20, which have undergone area separation and partial attachment in the step of separating internal pockets, with the outer edges coinciding with each other, and the entire section of the outlines of the intermediate sheet 15 and the second sheet 20 are sewn.

As can be seen from the fabrication method described above step by step, although the bag for a pocket according to the present invention has a very useful and complicated structure in comparison to pocket bags of the related art, the difference from the process of fabricating a pocket of the related art is limited to the steps of preparing the intermediate sheet 15 and separating and attaching the intermediate sheet 15 and the second sheet 20, and the other steps are almost the same as the process of fabricating common pocket bags.

Therefore, this means that it is possible to easily produce the bag for a pocket according to the present invention in an existing fabrication line without a change in the process of fabricating common pocket bags, which can be an economically remarkable advantage for the manufacturer.

Although the present invention was described with reference to the drawings according to preferable embodiments, the present invention is not limited to the configurations and operations shown in the drawings and described in the embodiments. Those skilled in the art may understand that the present invention may be modified and changed in various ways without departing from the spirit and scope of the present invention which are described in claims. Therefore, it should be understood that all of appropriate modifications, changes, and equivalents are included in the present invention.

The invention claimed is:

1. A structure for a pant pocket with a plurality of internal pockets, comprising:

a first sheet and a second sheet of which edges are attached throughout an entire section except at a partial section of the entire section, in which the partial section not attached forms a main inlet and an edge of the main inlet is attached to an inner side of an opening of the pant pocket into which a hand may be inserted, wherein the structure for a pant pocket further comprises an intermediate sheet that is disposed between the first sheet and the second sheet, with an edge of the intermediate sheet attached to the second sheet and has at least two or more internal inlets formed in a shape of a through-hole though both sides of the intermediate sheet so that going in and out of an internal space formed by the attachment of the second sheet and the intermediate sheet is possible, an internal pocket attachment line for attaching the second sheet and the intermediate sheet to separate different areas within the pant pocket including the two or more internal inlets, respectively is provided, and an edge of the first sheet is attached to the intermediate sheet to form the main inlet.

2. The structure of claim 1, wherein the intermediate sheet and the second sheet are similar in shape, the first sheet has a shape with a portion of an edge of the first sheet cut in a same shape of sheet as the intermediate sheet and the second sheet, and the attachment line for attaching the second sheet and the intermediate sheet, and edges of the intermediate sheet and the first sheet is a seam for attaching outer edges of the intermediate sheet and the second sheet, with the first sheet, the intermediate sheet, and the second sheet overlapped in the same shape.

3. The structure of claim 1, wherein the internal inlets of the intermediate sheet are formed in a long slot shape extending from one point on a surface of the intermediate sheet to edge portion.

4. The structure of claim 2, wherein the intermediate sheet and the second sheet are similar in shape, the first sheet has a shape with a portion of the edge of the first sheet cut in the same shape of sheet as the intermediate sheet and the second sheet, and the attachment line for attaching the second sheet and the intermediate sheet, and the edges of the intermediate sheet and the first sheet is a seam for attaching the outer edges of the intermediate sheet and the second sheet, with the first sheet, the intermediate sheet, and the second sheet overlapped in the same shape.

5. A method of fabricating a structure for a pocket with a plurality of internal pockets, the method comprising:

preparing a similar shape of a second sheet and an intermediate sheet, and a first sheet shaped by cutting a portion of an edge of the first sheet in a same shape as the second sheet and the intermediate sheet;

forming at least two or more internal inlets in a shape of a through-hole through both sides of the intermediate sheet;

overlapping the intermediate sheet with two or more internal inlets and the second sheet such that outer edges coincide with each other, and then forming an internal pocket attachment line attaching the second sheet and the intermediate sheet to separate different areas within the pant pocket each including one of the internal inlets; and sewing an entire section of the overlapped outlines of the intermediate sheet and the second sheet after overlapping the first sheet, the intermediate sheet, and the second sheet, with the outer edges coinciding with each other, after the separating of internal inlets.

6. The method of claim 5, wherein the two or more internal inlets of the intermediate sheet are formed in a long slot shape extending from one point on a surface of the intermediate sheet to an edge portion.

* * * * *